United States Patent [19]

Miller

[11] Patent Number: 4,465,179

[45] Date of Patent: Aug. 14, 1984

[54] JEWELRY HOLDER FOR PIERCED EAR EARRINGS

[76] Inventor: Beverly A. Miller, 33W370 Woodmere, Wayne, Ill. 60184

[21] Appl. No.: 483,945

[22] Filed: Apr. 11, 1983

[51] Int. Cl.[3] ..... A45C 11/00; B65D 5/50; B65D 73/00

[52] U.S. Cl. ..... 206/37; 150/36; 206/45.14; 206/566

[58] Field of Search ..... 206/566, 45.31, 45.14, 206/37; 150/34, 36

[56] References Cited

U.S. PATENT DOCUMENTS

| | | | |
|---|---|---|---|
| 444,272 | 1/1891 | Benn | 150/34 |
| 510,072 | 12/1893 | Le Brun | 150/34 |
| 1,214,282 | 1/1917 | Day | 150/34 |
| 1,959,675 | 5/1934 | Hogg | 150/34 |
| 2,435,032 | 1/1948 | Campbell | 150/36 |
| 2,611,573 | 9/1952 | Young | 150/34 UX |
| 4,043,449 | 8/1977 | Love | 206/566 |

FOREIGN PATENT DOCUMENTS

| | | | |
|---|---|---|---|
| 2046587 | 3/1980 | United Kingdom | 150/34 |

*Primary Examiner*—William T. Dixson, Jr.
*Attorney, Agent, or Firm*—Wood, Dalton, Phillips, Mason & Rowe

[57] ABSTRACT

A jewelry holder especially adapted for receipt of earrings for pierced ears. The holder includes a small pouch-like container made of flexible material and has an interior with an access opening closable by a zipper. A flexible tab is connected to the container on the interior thereof and is sized to fit wholly within the container or alternatively extend substantially out of the interior through the access opening when the zipper is open. The tab defines a pierced ear earring holder on which earrings may be mounted when the tab is on the exterior of the container and which firmly holds the earrings for storage when the tab is within the interior of the container and the zipper closed.

5 Claims, 4 Drawing Figures

JEWELRY HOLDER FOR PIERCED EAR EARRINGS

FIELD OF THE INVENTION

This invention relates to a jewelry holder, and more specifically, to a jewelry holder for receipt of earrings for pierced ears.

BACKGROUND OF THE INVENTION

Over the years, jewelry has been kept in a variety of containers as, for example, well-known jewelry boxes. Most such containers have a rigid exterior shell with a hinged lid and may vary in bulk substantially. In general, they cannot be considered to be readily portable as in a purse or a pocket due to their bulk and/or the inconvenience posed by their rigid shell construction.

In addition, while such jewelry boxes may fulfill functions of displaying jewelry while on sale, holding jewelry while not in use, etc., their capabilities are generally limited to such uses and the same are not particularly flexible in terms of being easily usable in other settings.

Non-rigid, fabric jewelry holders have been devised, generally for the purpose of providing a container for receipt of jewelry during traveling or the like. For example, one such jewelry holder is formed out of a flexible fabric construction of about 5 by 8 inches and is divided into two zippered pouches. Jewelry may be placed in the pouches and the assemblage folded into thirds. A tie is provided for holding the assemblage in such a configuration so that it may be easily disposed in a purse, suitcase or the like. In some instances, the basic rectangle of material may be provided with an elongated finger on which rings may be received.

One difficulty with this construction is the fact that a person wishing to retrieve jewelry must search through the pouches to find the parts thereof, a process which may be difficult where small jewelry items are concerned. Another difficulty arises in the fact that when assembled as mentioned, the structure is open-ended at both ends and any jewelry not firmly secured in place may fall out of the assemblage.

Particular difficulty arises in the case of small jewelry of multiple part construction such as earrings for pierced ears. As is well-known, such earrings include a post which extends through the pierced ear and terminates on one end with a decorative portion or the like. A retainer or backing is slipped on the post from the other end for the purpose of retaining the earring on the pierced ear.

The backings used in such earrings are quite small, typically having a length of less than $\frac{1}{4}''$ and top to bottom and width dimensions of $\frac{1}{8}''$ or less. When the backings become disassociated from the posts during storage of the earring, they are frequently difficult to find even if such dissociation occurs in a purse or jewelry holder. And, of course, once a backing cannot be found, the earring cannot be worn until the backing is replaced.

Not infrequently, wearers of earrings for pierced ears find the need to temporarily remove the earring as, for example, when performing an athletic endeavor or the like. Since such events typically occur in a setting remote from the wearer's residence, frequently there will be no convenient place to store the removed earring in such a way that the components thereof are easily retrievable and will not become lost. While flexible jewelry holders of the type mentioned above may be of some assistance on such an occasion, their drawbacks make it clear that they are not a complete solution to the problem.

SUMMARY OF THE INVENTION

It is the principal object of the invention to provide an new and improved jewelry holder especially adapted for the receipt of earrings for pierced ears. More specifically, it is an object of the invention to provide such a jewelry holder that may be readily used at locations remote from the jewelry wearer's residence and which assure that jewelry parts cannot become dissociated from each other in such a way that they cannot be readily located.

An exemplary embodiment of the invention achieves the foregoing objects in a construction including a small pouch-like container made of flexible material and having an interior with an access opening. A zipper is secured to the container about the access opening and is operable to expose or completely close off the interior. A flexible tab is connected to the container on the interior thereof. The tab is sized to fit wholly within the container or alternatively extend substantially out of the interior through the access opening when the zipper is opened. The tab defines means to pierceably receive the post of an earring for pierced ears such that the decorative end of the earring is on one side of the tab and the backing of the earring may be applied to the post on the opposite side of the tab to secure the earring to the tab. The tab, with the earring secured thereto, may then be placed within the interior of the container and the zipper closed.

As a result of this construction, storage of earrings for pierced ears is facilitated by the tab. The nature of the container assures its portability and adaptability for use in locations remote from the earring wearer's residence. Furthermore, should, after the earring has been mounted on the tab, the parts of the earring become disassociated, they are retained within the small pouch-like container and easily retrieved, thereby eliminating the problem of loss of earring components.

The small size of the container readily adapts the same for disposition in a purse, pocket or the like enhancing its portable character.

In a highly preferred embodiment, the container and the tab are each made of fabric and the tab is connected to the container interior by stitching and defines a hinge to facilitate movement of an end of the tab into and out of the container.

In one embodiment of the invention, the tab includes small holes for receiving the posts of earrings. The edges of the holes are embroidered to prevent enlargement thereof and the embroidery further forms part of the decorative pattern on the tab.

Preferably, the stitching forming the hinge is located in close proximity to the access opening.

Other objects and advantages will become apparent from the following specification taken in connection with the accompanying drawings.

DESCRIPTION OF THE PREFERRED EMBODIMENT

Figure 1:
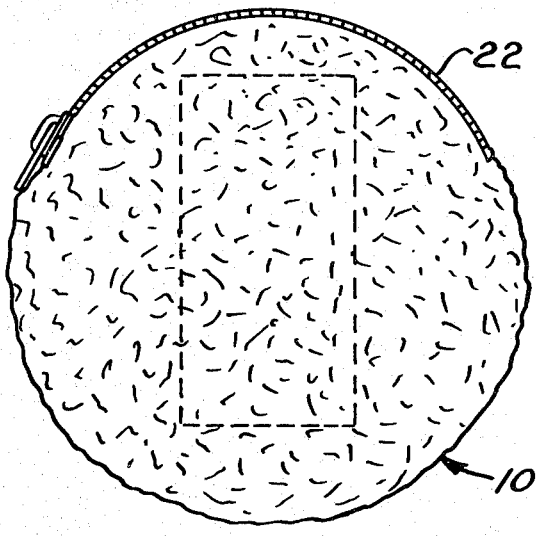
FIG. 1 is a perspective view of a jewelry holder made according to the invention in a closed condition.

An exemplary embodiment of a jewelry holder made according to the invention is illustrated in the drawing and is seen to include a small pouch-like container, generally designated 10. As illustrated, the same is circular in configuration but the invention contemplates that it may be made in other shapes as well.

The container 10 is made of flexible material, preferably a fabric. In the preferred embodiment, a plush-type fabric is employed and the container 10 is formed by sewing front and rear sides 12 and 14 respectively together along a line of stitching 16 and then inverting the same to hide the stitching and expose the plush-type exterior.

The stitching 16 does not extend about the entire periphery of the front and rear sides 12 and 14. Rather, a portion of the periphery is left open to define an access opening 20 to the interior of the container thus formed. A conventional zipper 22 is disposed on either side of the access opening 20 as by sewing to the front and rear sides 12 and 14. The arrangement is such that the stitching 16 and the zipper 22, when closed, completely close off the interior of the container 10 so as to prevent even small jewelry parts from exiting the interior of the container when they are disposed therein.

Of course, the zipper 22 may be opened to expose the interior of the container 10 to allow jewelry to be placed therein or removed therefrom.

Figure 2:
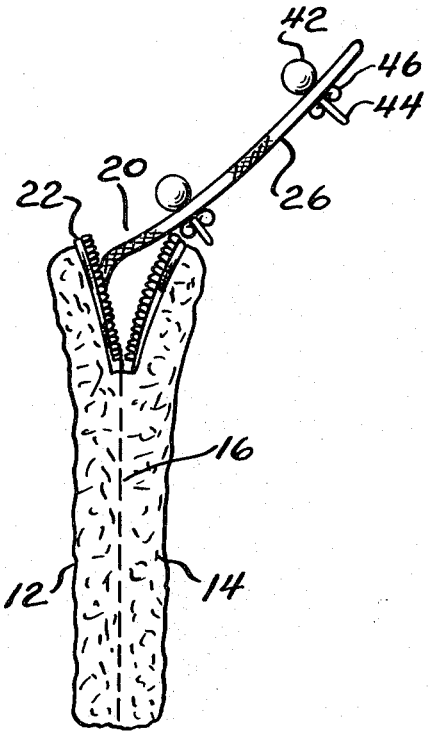
FIG. 2 is a side elevational view of the jewelry holder with its access opening in an open condition and with the jewelry holding tab extending out of such opening.
Figure 3:
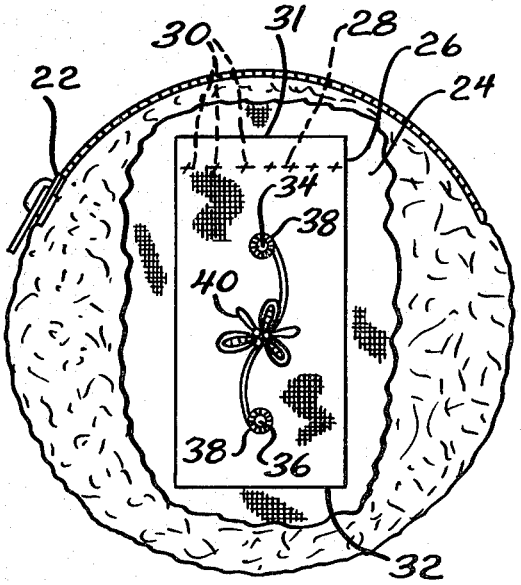
FIG. 3 is a view similar to FIG. 1 but with part of the jewelry holder broken away for clarity to show the interior thereof.
Figure 4:
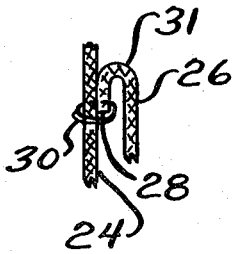
FIG. 4 is a fragmentary, enlarged view of part of the tab.

As seen in FIG. 3, the interior of the container 10 is provided with a fabric lining 24 and a tab 26, preferably in the form of a rectangular piece of cloth, is likewise located within the interior of the container. One end 28 of the tab 26 is secured as by stitching 30 to the lining 24 in close proximity to the access opening 20. Alternately the tab end 28 may be bonded to the lining 24 as by a heat bond when both the tab 26 and the lining 24 are formed of synthetic fabric. The end 28 is preferably directed downwardly to hide the stitching or bond and an adjacent fold 31 defines a hinge to facilitate movement of the tab into and out of the container 10. The tab 26 has a length such that its end 32 opposite the end 28 may be readily disposed within the interior of the container 10, preferably in close proximity to the bottom of the container 10 and yet may be almost wholly pivoted out of the container 10 through the access opening 20 as shown in FIG. 2.

In a highly preferred embodiment, the tab 26 is provided with small holes 34 and 36 for purposes to be seen. Embroidery stitches 38 surround each of the holes 34 and 36 and may form part of a decorative design 40 on the tab. While not shown herein, similar decorative stitching may be employed on the three unsecured edges of the tab 26.

In use, an earring for pierced ears is grasped by its decorative end 42 and manipulated such that the post 44 thereof is inserted through one of the holes 34 or 36. The backing 46 of the earrings may then be applied to the post 44 to secure the earring to the tab. Two or more earrings may be secured in such fashion. And, of course, if the holes 34 and 36 are omitted, the same result may be obtained simply by piercing the fabric of the tab 26 with the post 44.

After the earrings have been mounted on the tab 26 as shown in FIG. 2, the tab 26 may be pivoted into the interior of the container 10 and the zipper 22 completely closed. The container may then be placed in a purse or a pocket for storage.

When it is desired to retrieve the earrings, the zipper 22 is merely opened and the tab 26 removed from the interior of the container 10 to assume approximately the position shown in FIG. 2. At this time, the earrings may then be removed from the tab 26.

Should, after the earrings are disposed within the interior of the container 10 on the tab 26 with the zipper closed, the backing 46 disassociate itself from the post 44, it will be retained within the interior of the container 10. Upon opening the same, the disassociated parts may be readily found because of the small size of the container and the presence of the lining 24.

And, of course, the container 10 may be used to simultaneously store other small items of jewelry as, for example, rings, small necklace chains or the like.

In general, to enhance portability, it is preferred that a container such as shown in the drawings have a diameter on the order of 3–3½". In some instances, however, the pouch size may be made somewhat greater if desired.

From the foregoing, it will be appreciated that a jewelry holder made according to the invention is particularly well suited for the temporary storage of earrings for pierced ears. The unique nature of the tab 26 makes it extremely easy to achieve access to stored earrings within the container such that one need not hunt about the interior of the container to find the same. Even should the jewelry parts become disassociated from each other and from the tab 26 during storage, the small size of the container makes them relatively easy to find. The flexible nature of the container and its small size renders the same readily portable and easily carryable in, for example, a pocket or a purse and simply by closing the zipper 22 after the storage of jewelry in the container, any possibility of losing one or more component parts of the jewelry is completely eliminated.

I claim:

1. A jewelry holder especially adapted for receipt of earrings for pierced ears comprising:

a small pouch-like container made of flexible material and having an interior with an access opening;

a zipper secured to said container about said access opening and operable to expose or completely close off said interior; and a flexible tab connected to said container on the interior thereof and sized to fix wholly within said container and alternatively extend substantially out of said interior through said access opening when said zipper is opened;

said tab defining means to piercably receive the post of an earring for pierced ears such that the decorative end of the earring is on one side of said tab and the backing of the earring may be applied to the post on the opposite side of the tab to secure the earring to the tab;

whereby the tab, with an earring secured thereto, may be placed within said interior and the zipper closed to assure safekeeping of the earring.

2. The jewelry holder of claim 1 wherein said container and said tab are each made of fabric, said tab is connected to said container interior by a connection at one end of the tab, said tab including a fold adjacent said connection for hiding said connection and defining a hinge.

3. The jewelry holder of claim 2 wherein said tab includes small holes for receiving the posts of earrings and wherein the edges of said holes are embroidered to prevent enlargement thereof with the embroidery further forming part of a decorative pattern on said tab.

4. The jewelry holder of claim 2 wherein said container is provided with a fabric lining and said connection secures said tab to said lining.

5. The jewelry holder of claim 4 wherein said connection is located in close proximity to said access opening.

* * * * *